US005993326A

United States Patent [19]

Hitchman et al.

[11] Patent Number: 5,993,326

[45] Date of Patent: Nov. 30, 1999

[54] GOLF PRACTICE DEVICE

[75] Inventors: Thomas M. Hitchman; Jerald J. Olson, both of Olympia, Wash.

[73] Assignee: Visualizer Golf, LLC, Olympra, Mass.

[21] Appl. No.: 09/209,191

[22] Filed: Dec. 10, 1998

[51] Int. Cl.[6] ..... A63B 69/36

[52] U.S. Cl. ..... 473/257; 446/107; 446/119; 446/126

[58] Field of Search ..... 473/257, 258, 473/259, 260, 261, 264, 265; 446/119, 107, 126

[56] References Cited

U.S. PATENT DOCUMENTS

| | | | |
|---|---|---|---|
| 1,005,948 | 10/1911 | English | 473/260 |
| 2,869,875 | 1/1959 | Steenson . | |
| 3,604,711 | 9/1971 | Hansburg | 473/257 |
| 4,953,865 | 9/1990 | Coombs et al . | |
| 5,037,100 | 8/1991 | Montgomery | 473/261 X |
| 5,209,484 | 5/1993 | Randall | 473/265 |
| 5,273,284 | 12/1993 | Montgomery . | |
| 5,375,833 | 12/1994 | Marier | 473/257 X |
| 5,624,326 | 4/1997 | Hohl et al. . | |

*Primary Examiner*—George J. Marlo

[57] ABSTRACT

A golf practice device consisting of a series of interlocking tubes (13a through 13d) which are supported and raised by end stands. The end stands consist of an anchor ball (11a and 11b) supported by two supporting legs (10a through 10d). The tubes are connected to each other by pins (14a through 14c) inserted into the ends of the tubes, and to the anchor balls by insertion into a hole in the equator of each anchor ball. The legs are angled toward the device at such an angle that the weight of the anchor ball and of the legs serves to remove any sag from the length of interconnected tubes, and to hold and support the length of tubing straight or in several different curvatures. Hollow balls (12a through 12j) are inserted onto and evenly spaced along the length of interconnected tubes to serve as aids to development of visualization skills. The device is used to practice golf putting and chipping mechanical skills and visualization skills.

5 Claims, 5 Drawing Sheets

GOLF PRACTICE DEVICE

BACKGROUND

1. Field of Invention

This invention relates to practice devices to improve golf putting mechanical skills and mental image visualization skills.

2. Description of Prior Art

Putting and short shots around the putting greens comprise nearly 60 percent of all the strokes taken in a round of golf. Through the years, various devices and methods for teaching people to become more proficient at putting, chipping, and pitching have been developed in an attempt to improve golfers skills and lower their scores. A search of the U.S. patent literature has disclosed a number of such aids, including the following:

U.S. Pat. No. 2,869,875 (Steenson, Jan. 20, 1959), discloses what is called a "golf practice game". This patent provides two "U" shaped wickets, which can be positioned apart from one another, and a cord or string is stretched between the two wickets at a location possibly several inches or a foot above the ground surface. This cord serves as an alignment guide for the person practicing the putt or possibly a short chip shot.

U.S. Pat No. 3,604,711 (Hansburg, Sep. 14, 1971), shows an upright post which may be secured in the putting green at the position of the ball, the post rigidly mounting a reel at its lower end which carries a cord or tape which may be extended and secured at the edge of the golf hole, the tape serving as an alignment guide for the golfer.

U.S. Pat. No. 4,953,865 (Coombs and Anderson, Sep. 4, 1990), shows a pair of spaced rows of pegs which extend upwardly from an elongated, planar base, which are used as guide through which to aim a putted ball toward a hole.

U.S. Pat. No. 5,273,284 (Montgomery, Dec. 28, 1993), shows a putting device that has a pair of guide rods so that the person can align his or her putting stroke.

U.S. Pat. No. 5,624,326 (Hohl and Bidleman, Apr. 29, 1997), shows a system of stakes stuck into a putting green with a raised cord tied between the stake at the putting location and the stake placed at the putting cup. The golf ball is placed beneath the raised cord at the putting location, and the putting stroke is executed to putt the ball from the putting location (at least initially) along the target line, visually utilizing the initial portion of the cord for alignment of the putting stroke.

DISADVANTAGES OF PRIOR ART (a) None of the prior inventions have the capability to provide a view for the golfer to visually follow the complete intended path of the ball on a curving putt.

(b) None of the prior inventions have a component to increase the golfer's ability to mentally visualize, or "preview", the path of the ball before actually striking it. All prior art uses visually unstimulating strings or spaced pegs to represent the path of the ball toward the putting cup.

(c) Many of the prior inventions are intrusive and damaging to a golf green (Hansburg, U.S. Pat No. 3,604,711, Sep. 14, 1971; Hohl, U.S. Pat. No. 5,624,326, Apr. 29, 1997; Steenson, U.S. Pat. No. 2,869,875, Jan. 20, 1959). These devices utilize stakes or spiked flanges to anchor the device to the putting green.

ADVANTAGES OF PRESENT INVENTION

We wanted a device that would help golfers form mental imagery and visualize a complete putt from the putting position to the cup, while reinforcing good putting mechanics. Our golf practice device improves on prior art in several important ways:

(a) Our device is made of flexible aluminum tube segments which can be flexed bilaterally to hold a specific curve, thus enabling the golfer to delineate with the device the actual path the ball will follow to the putting cup on a curving putt. The golfer can visually align his putt along the entire length of the device, from the putting location to the cup, and not just along an initial cord or rod. Very few putts are absolutely straight due to the nature of grass, thereby rendering devices using only straight alignment guides, such as tight strings or rods, inadequate for most putting situations.

(b) The spaced hollow balls along the span of aluminum tubing create an irresistible mental image of the path the ball must follow to arrive in the putting cup. The strong visual image subconsciously helps the body's muscles stroke the ball with the appropriate speed and alignment to guide it into the cup.

(c) Our device also flexes vertically, allowing the golfer to set up and simulate a chipping or pitching shot from off the green. The device visually scribes the arc a successful chip shot will follow on its way onto the green and toward the cup.

(d) Our device will allow the golfer to more successfully practice a far wider variety of shots, including breaking putts and chip shots, than prior art.

(e) Because the device can be aligned along the actual path of a successful putt, it is an invaluable tool for diagnosing and correcting mechanical faults in a golfer's putting stroke. With his ball placed directly beneath the span of aluminum tubing, the golfer can tell immediately if his putter face is not aligned correctly so as to strike the ball along the intended path. The golfer can also tell during the putting stroke if his stroke was not straight on the putting line.

(f) Our invention is non-intrusive to the living grass of the putting green, simply resting lightly on top of the grass.

DRAWING FIGURES

VI. Reference Numerals in Drawings

Figure 1:
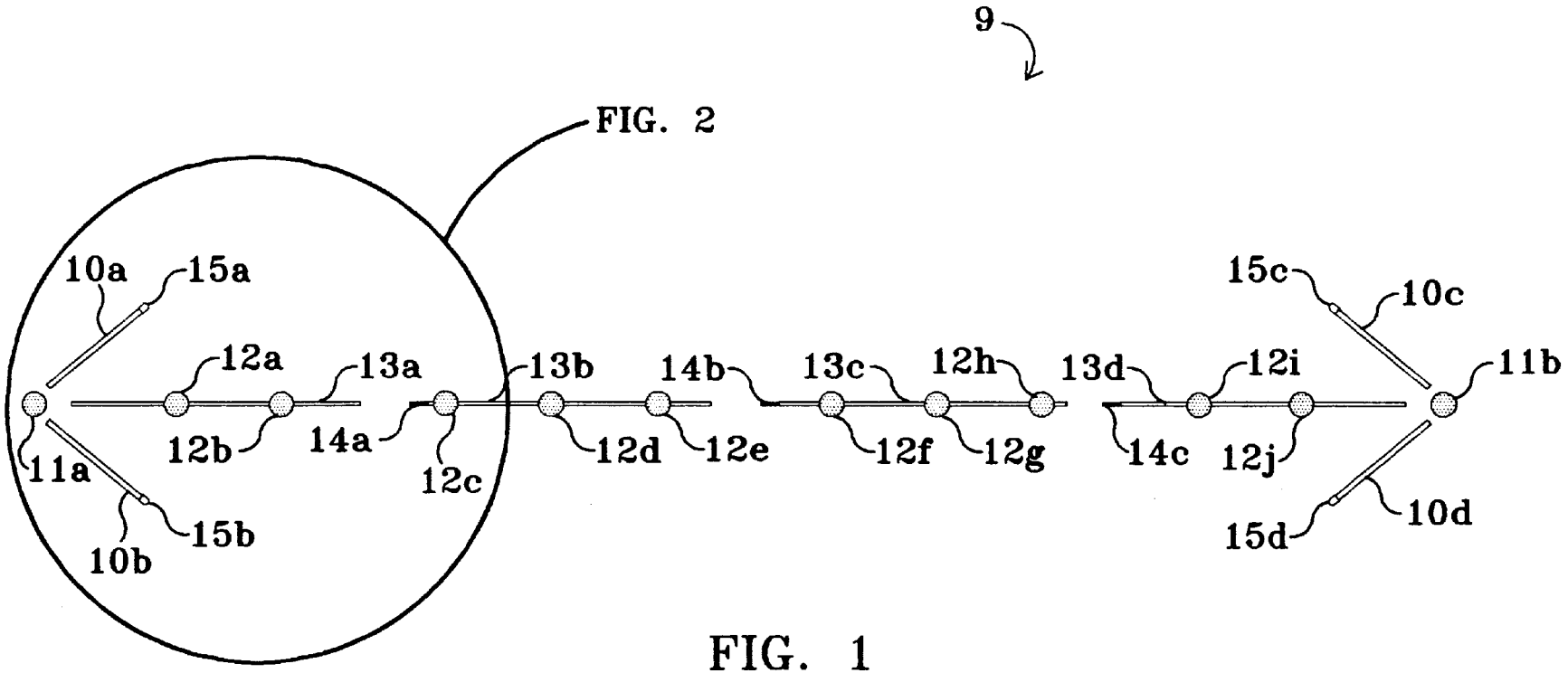
FIG. 1 is a top plan view of our practice device showing the main components of the device.

| | |
|---|---|
| 9 | Complete device |
| 10a through 10d | Legs |
| 11a and 11b | Anchor balls |
| 12a through 12j | Hollow balls |
| 13a through 13d | Tubes |
| 14a through 14c | Pins |
| 15a through 15d | Cap |
| 16 | Foot locations |
| 17 | Golf ball |

-continued

| VI. Reference Numerals in Drawings | |
|---|---|
| 18 | Putter head |
| 19 | Putting cup |
| 20 | Lofted iron club |

SUMMARY

Our gold practice device consists of a series of interlocking tubes which are supported and raised by two opposing end stands. Hollow balls serving as visual aids are spaced along the length of the interlocking tubes. The interlocked tubes can be flexed and held from side to side, either laterally or vertically, to represent the path of a golf ball from the putting position (or chipping position) toward the golf hole.

DESCRIPTION

Figures 3A, 3B, 3C:
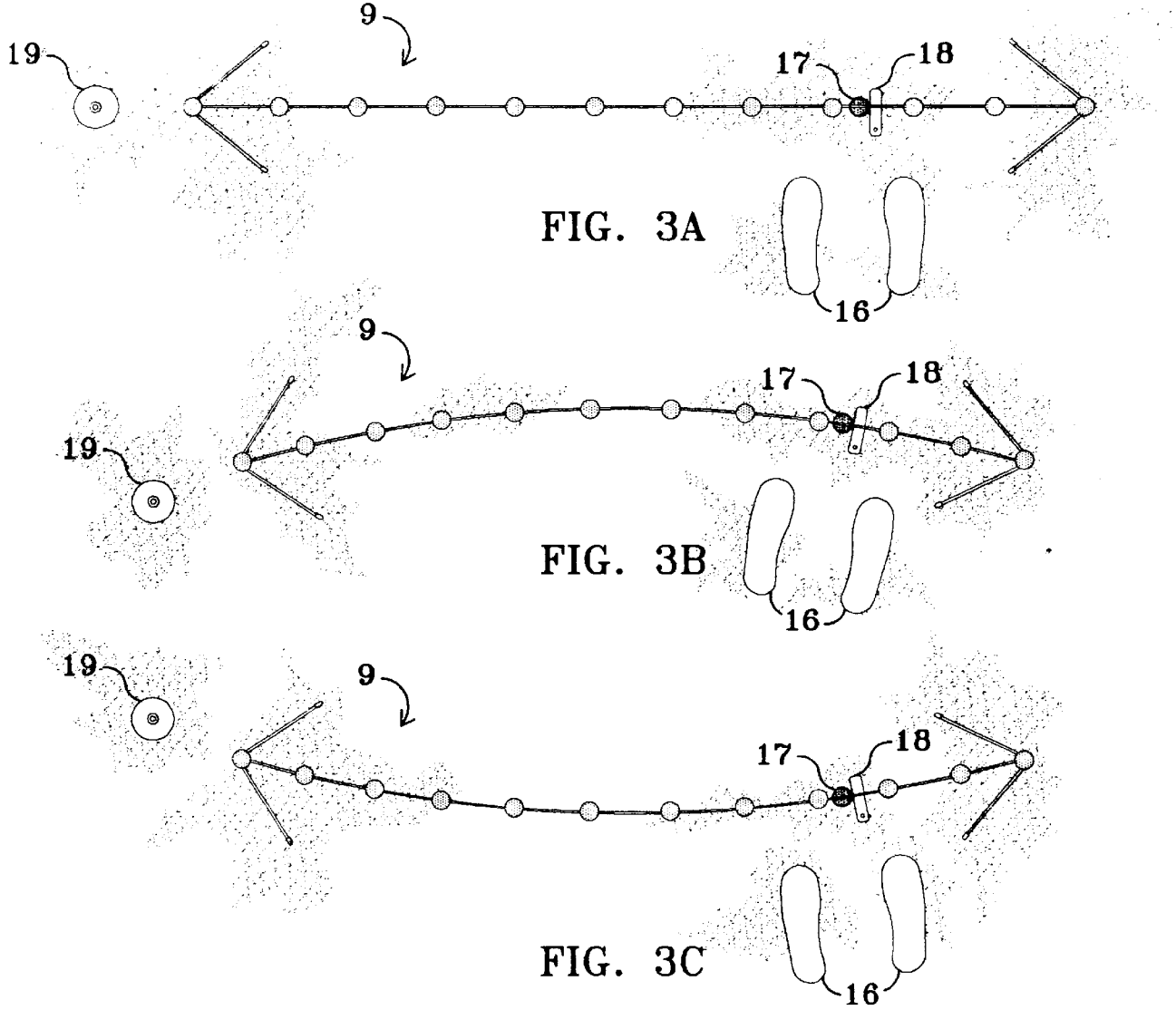
FIGS. 3A, 3B and 3C are top plan views of typical embodiments the device.

A typical embodiment of the present invention 9 is represented in FIG. 3A. The individual parts and their connections to each other are shown in FIG. 1.

Two legs, 10*a* and 10*b*, are inserted into an anchor ball 11*a*. A tube 13*a* is inserted into anchor ball 11*a*. Tube 13*b* is connected to tube 13*a* by a pin 14*a*. Tube 13*c* is connected to tube 13*b* by pin 14*b*. Tube 13*d* is connected to tube 13*c* by pin 14*c*. Tube 13*d* is inserted into anchor ball 11*b*. Two legs, 10*c* and 10*d*, are inserted into anchor ball 11*b*.

Tubes 13*a* through 13*d* are made of aluminum tubing approximately 20 inches long and having an outside diameter of about 3/16 inch. The tubes are connected to each other by the insertion of an 1/8 inch stainless steel pin 14*a* through 14*c* into the ends of the tubes. Pin 14*a* is glued into one end of tube 13*b*. Pins 14*b* and 14*c* are similarly glued into tubes 13*c* and 13*d*. Tube 13*a* receives no glued pin. The tubes fit together by a male-female connection with the glued pin of one tube sliding into the hollow end of the next tube.

The interconnected tubes are raised off the ground by two opposing end stands. A stand consists of an anchor ball (11*a* and 11*b*), which is a standard golf ball into which three holes have been drilled. (FIG. 2, 11*a*) A center hole of about 3/16 inch diameter lies on the equator of each anchor ball, faces the device and receives one of the tubes (13*a* or 13*d*). Two leg holes of about 1/4 inch diameter face down at approximately a 45 degree angle and are beneath the equator of the anchor ball. A solid brass leg (10*a* through 10*d*) about 1/4 inch in diameter and about 9 inches in length is inserted into each leg hole. The two legs (10*a*–10*b*, and 10*c*–10*d*) are separated from each other by an approximately 90 degree angle. The legs are angled approximately 45 degrees inward towards the device (see FIG. 4A) and not directly underneath the anchor balls. A black plastic cap (15*a* through 15*d*) is affixed to the bottom end of each leg.

Figure 2:
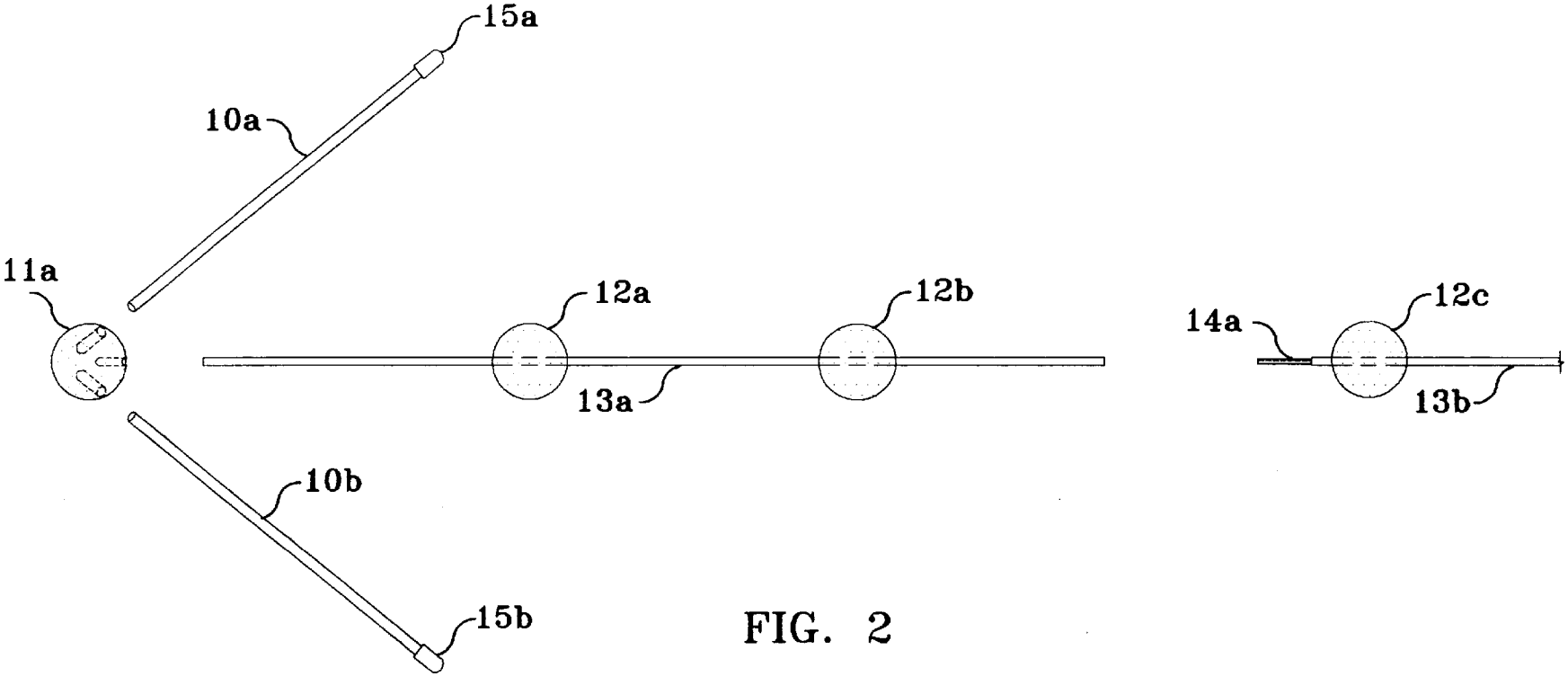
FIG. 2 is a top plan view in enlarged detail of the section encircled in FIG. 1.

In FIG. 2, a hollow ball 12*a* with two 3/16 inch holes in its poles is positioned on tube 13*a*. Hollow balls 12*b* through 12*j* (FIG. 1) are identical to 12*a* and are positioned on the tubes substantially equidistant from each other along the length of the four connected tubes. These hollow balls are roughly the size of a standard golf ball, approximately 1.6 inches in diameter, and are made of plastic.

OPERATION

The assembly of the device is fairly straightforward. The user first inserts two brass legs into each anchor ball. Then, tube 13*a* is inserted into anchor ball 11*a*. Two hollow balls, 12*a* and 12*b*, are pushed onto tube 13*a* through the holes so that the tube goes through the center of the balls. This is a frictional contact and requires minimal force to move the balls into position along the tube. The balls will stay in position until and unless moved. Three hollow balls, 12*c*–*e* and 12*f*–*h* are pushed onto tubes 13*b* and 13*c*, respectively. Tubes 13*b* and 13*c* are then connected to each other and to tube 13*a* via the inserted steel pins, 14*a* and 14*b*. Hollow balls 12*i* and 12*j* are pushed onto tube 13*d*, which is then connected to tube 13*c* by pin 14*c* at one end and inserted into anchor ball 11*b* at the other, taking care to position the two sets of legs both pointing downward. The device is now completely assembled and can be placed in position on the green.

A. Uniqueness of end stands

Figure 4A:
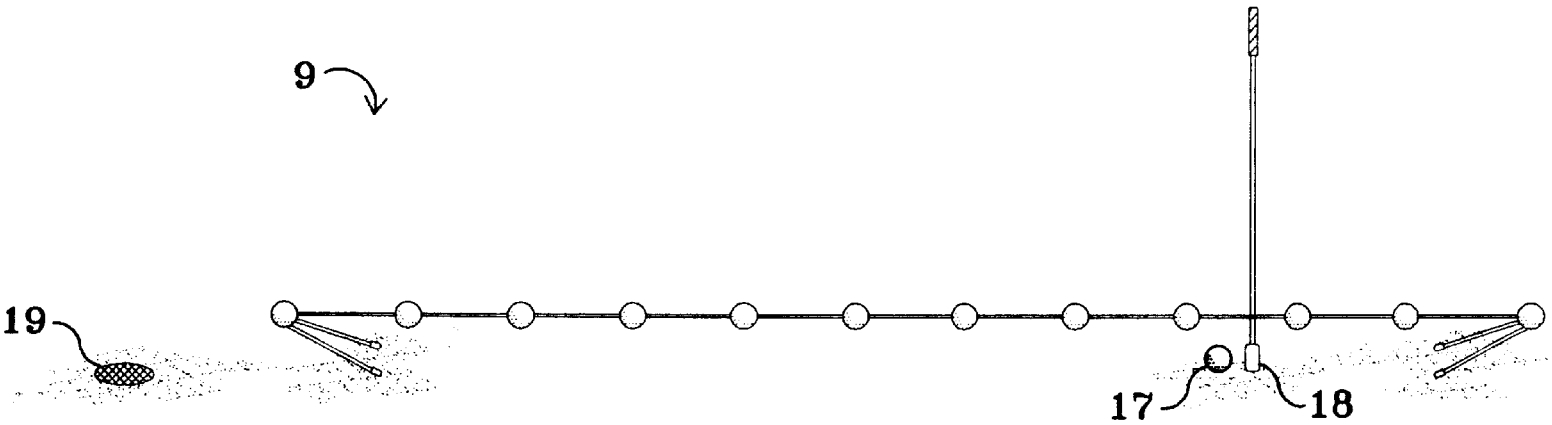
FIGS. 4A and 4B are isometric views of typical embodiments of the device.

FIG. 4A shows an isometric view of the device 9. This view depicts the height of the device off the ground of about 5 inches. It also shows the absence of any sag in the series of interconnected tubes. This absence of sag allows the golfer's golf ball to roll freely underneath the entire length of the device. Note the position of the legs in relation to the anchor balls. Due to the fact that the legs are not directly underneath the anchor balls, gravity acts on each anchor ball by pulling it down toward the putting surface. This force, in combination with the angled position of the legs, has the effect of eliminating the vertical sag in the series of tubes and supports the tubes.

B. Use of Device for Straight Putts—FIG. 3A

The manner of using our practice device 9 is first illustrated in FIG. 3A. The golfer must first look for a relatively flat putting surface on a putting green which should result in a substantially straight putt of a golf ball 17 into the putting cup 19. The right-handed golfer then aligns the device 9 along the intended path of the putted golf ball 17 from the intended putting position on his right toward the putting cup 19 to his left. (This position would be reversed for a left-handed golfer, with the putting cup on his right and the intended putting position on his left.) The legs of the device should be positioned so that the aluminum tubing is straight and level, horizontally and vertically, between the two anchor balls. In this position the tubing will be approximately 5 inches above the surface of the ground, directly above the intended path of the putted golf ball.

The golfer places a golf ball in any position he selects directly under the line of tubing of the device. Then he takes his stance in the foot locations 16 and addresses the golf ball with the putter head 18. The golfer is now ready to make a putting stroke sending the golf ball directly underneath the device 9 and into the putting cup 19. Any error on his part will be reflected in the discrepency between the path of the device and the actual path of the putted golf ball.

One of the most important putting fundamentals is the alignment of the putter head 18. The striking surface of a correctly aligned putter head should be perpendicular to the intended line of the putt. FIG. 3A delineates the placement of the putter head perpendicular to the series of aluminum tubes. This starting position will give the golfer the best chance at hitting the golf ball straight underneath the length of the device. The series of tubes provides a strong reference to the golfer on whether or not her putter head is perpendicular to the intended path to the putting cup.

The complete device 9 provides instant feedback for the golfer's analysis as to her performance in putting the golf ball. In FIG. 3A, the golf ball must travel the entire length of the complete device and emerge traveling through and beyond the two legs and into the putting cup 19. Having accomplished this feat the golfer will be absorbing and practicing the feel of proper speed and distance needed on that particular putt. The golfer's success at achieving proper direction on the putted golf ball is also readily discernible. Any deviation of the putted golf ball's path from the path of the device will show up and result in the golf ball missing the putting cup.

C. Use for Curving Putts—FIGS. 3B and 3C

Another feature of our practice device is depicted in FIG. 3B which shows the device 9 in a curved position. To achieve this unique shape the golfer simply locates on the putting surface some ground that has a lateral slope relative to the intended putting path. In the case of FIG. 3B, the golfer standing in the foot locations 16 would view the ground sloping upward in front of him.

The golfer then positions the device with one end near the putting cup 19 and the other end to the right of the foot locations 16. Then the golfer simply turns both end stands outward towards the high side of the lateral slope. This turning of the end stands positions the legs of each anchor ball in a more generally facing direction to the high ground. With the legs in this position, and due to their weight and inertia, the interlocking tubes will be flexed and held in a curved configuration until and unless the legs are repositioned.

The degree to which the anchor balls and corresponding legs are turned determines how much of a curve will be created in the series of interlocking tubes. Thus the golfer can practice a wide range of curving putts having varying degrees of lateral slope.

Also as seen from FIG. 3C the device works just as well when the putting surface has a lateral slope to the intended putting path having the ground higher behind the golfer standing in foot locations 16. The same setup procedure is followed by the golfer as described in the preceding paragraphs. The legs, as before, are positioned in a direction more generally facing the higher side of the putting surface. This will flex the tubes in a curved configuration which will be representative of the actual curving path of the putted golf ball 17 along the putting path to the cup 19.

The farther the anchor balls and legs are turned out toward the higher side of the laterally sloping ground, the greater the curvature in the tubes. By experimenting with varying amounts of curvature on the tubes the golfer will gain skill in estimating how much the particular putt will break before arriving at the putting cup. Immediate feedback will be present as the golfer watches his efforts at putting the golf ball underneath the device. The golfer would know from setting up his putt under the device whether the putter head was properly aligned. Assuming that it was, and the putted ball still wandered astray from underneath the tubes, either the speed at which the golfer hit the putt was incorrect, or the amount of lateral slope on the putting surface was not accurately represented by the amount of curve in the tubes. The golfer then makes adjustments in his stroke speed and/or the curvature of the device until the putted ball goes into the putting cup. The golfer can then "train" his mechanical skills and visualization skills on successive putts from the same position.

D. Use for Advanced Practice—FIG. 4B

Figure 4B:
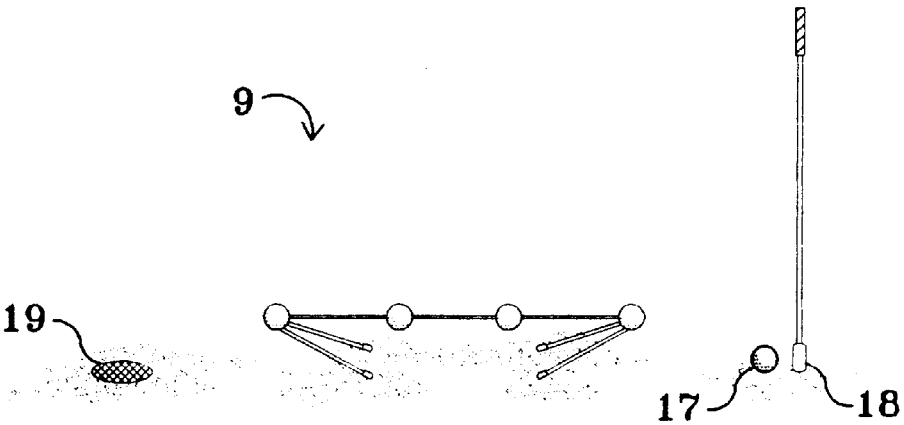

FIG. 4B is an isometric view illustrating another embodiment of the device. By using only one tube the device has been substantially shortened in length. The golfer is now positioned closer to the putting cup 19 enabling the golfer to practice short putts. Also the golf ball 17 and the putter head 18 are positioned outside of the device 9, and not underneath it. This embodiment is an advanced form of practicing putting. The golfer now must align his putter head 18 unaided by the direct alignment reference of the device 9. Without the aid of the tubes acting as a cross-hair over the putter head 18, the golfer must create a proper alignment of the putter head to the device 9 and to the path of the intended putt using only his own visual skills.

E. Use for Short Lofted Iron Shots—Chipping—FIG. 5A

Figure 5A:
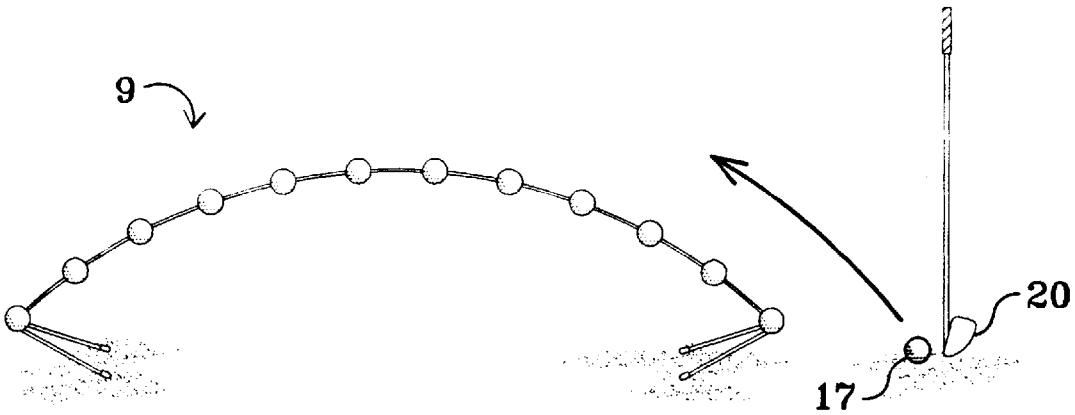
FIG. 5 is an isometric view of the device.
FIG. 5B is an isometric view of the device with vector arrows the forces at work on the device.
Figure 5B:
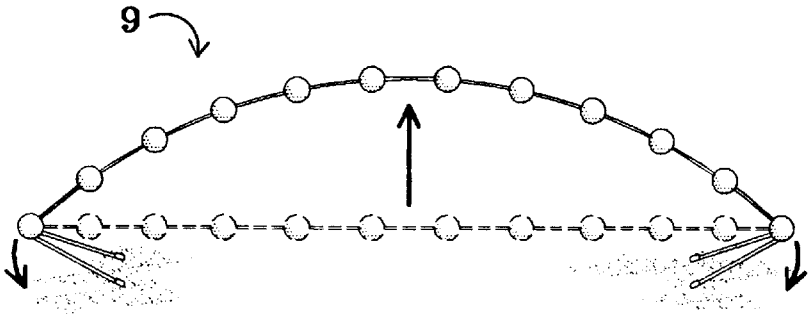

A further embodiment of the device 9 is shown in FIG. 5A. The device is postioned in a vertical arc which is representative of the path the golf ball 17 will follow when struck by a lofted iron club 20. To place the device in this position the golfer places the legs closer to a horizontal position on the ground, bringing the anchor balls nearer to the ground. This positioning exerts a upward force on the tubes as shown in FIG. 5B. The tubes are then arranged in a rainbow arc giving the golfer an alignment aid for short lofted shots. Also the device 9 provides the golfer with a mental image of how the short lofted iron shot should look when struck.

CONCLUSION, RAMIFICATIONS, AND SCOPE

Thus, the reader will see that the golf practice device of our invention provides a large number of configurations with which to practice and strengthen golf skills in putting and short lofted iron shots. The flexibility of the device enables the golfer to practice an infinite variety of curving and straight putts, as well as short lofted iron shots. The spaced hollow balls along the span of tubing present a irresistible mental image of the path the ball should follow, and a sense of the optimal speed for a successful putt. The device is non-intrusive to the living grass and can be used indoors or outdoors.

Many variations in usage are possible, in addition to the primary embodiments shown in FIGS. 3A through 5B and described above. For example, the device can also be positioned farther away from the putting cup, giving the golfer the ability to practice long or lag putts. The device can also be used for sand bunker shots, again showing the golfer the correct trajectory and path toward the putting cup. It can be used in instructional situations between instructor and student, or by any golfer alone. The length of the device can be adjusted to four separate lengths, depending upon the number of tubes which are used, providing the golfer with different configurations for shorter or longer putts. Varying the length of the device also provides the golfer with different "looks" which, in turn, encourage the further development of visual imaging skills.

One of the strongest ramifications of the device is its tendency to develop and improve the golfer's ability to mentally picture a successful shot before he strikes the golf ball. By practicing with the device the golfer will develop the visualization skills to utilize in actual playing situations, when the device itself is not available or allowed. In such playing situations, the golfer is left with only his or her mental skills to predict how the golf ball will travel on the putting surface, or at what trajectory the golf ball should follow on lofted iron shots. Good visualization skills are essential to successful golf shots, and training with our practice device will help develop and increase these skills.

While the above description contains many specificities, these should not be construed as limitations on the scope of the invention, but rather as exemplifications of the preferred embodiments thereof. The color, size or shape, etc. of the legs, tubes, anchor balls or hollow balls could be changed, as could the materials for any of those components. For example, stainless steel, aluminum or other alloys, wood, plastic, or other materials could be used for the legs instead of brass. Plastic, graphite or other composite materials, etc., could be used for the tubes. Wood, plastic or other material, in any other shape, could be used for either the anchor balls or the hollow balls. The hollow balls could be replaced by solid figures, or omitted entirely. The method of connecting the tubes to each other could be changed, for example, using outside couplers or by suaging the ends of the tubes, etc. The angles of the legs to the anchor balls could be either greater or lesser, as could the angle of the legs to each other, etc.

Thus the scope of the invention should be determined by the appended claims and their legal equivalents, rather than by the examples given.

We claim:

1. A golf practice aid assisting in the development of correct putting mechanics and putting and chipping path visualization skills, comprising several interlocking tubes which may be utilized singly or which may be connected to each other to form a visual representation of the putting or chipping path, which said tubes can be flexed or held in a straight or curved position, either horizontally or vertically, representing straight putts, curved putts and chip shots; and a supporting means to make taut, curve, hold and raise said interlocking tubes above the putting surface in a straight or curved configuration representing the path of the putted or chipped ball.

2. The practice aid as recited in claim 1, further including a series of spheres, resembling and representing golf balls, which are positioned on said interlocking tubes and evenly spaced along the length of said tubes, visually representing the path of the golf ball along the length of the practice aid.

3. The practice aid as recited in claim 2, wherein, said spheres are slideable and can be placed in any desired position.

4. The practice aid as recited in claim 1, wherein said supporting means comprises two opposing end stands, each having a weighted sphere with two support members inserted angularly into holes in said sphere.

5. The practice aid as recited in claim 4, wherein said weighted sphere is connected to said support members at such an angle that the weight of said sphere provides outward pressure which serves to support and make taut said interlocking tubes above the ground.

* * * * *